United States Patent [19]

Tapdrup et al.

[11] Patent Number: 4,897,066

[45] Date of Patent: Jan. 30, 1990

[54] TOY ACTIVITY CENTER

[75] Inventors: Erik P. Tapdrup, Virum; Flemming H. Olsen, Espergaerde, both of Denmark

[73] Assignee: Interlego A.G., Switzerland

[21] Appl. No.: 153,824

[22] PCT Filed: May 27, 1987

[86] PCT No.: PCT/DK87/00063

§ 371 Date: Jan. 29, 1988

§ 102(e) Date: Jan. 29, 1988

[87] PCT Pub. No.: WO87/07171

PCT Pub. Date: Dec. 3, 1987

[30] Foreign Application Priority Data

May 29, 1987 [DK] Denmark ..... 2516/86

[51] Int. Cl.[4] ..... A63H 3/16; A63H 33/06; A63H 33/08

[52] U.S. Cl. ..... 446/97; 446/118; 446/124

[58] Field of Search ..... 446/97, 104, 118, 121, 446/119, 124, 125, 126; 273/157 R

[56] References Cited

U.S. PATENT DOCUMENTS

| | | | |
|---|---|---|---|
| 176,144 | 4/1876 | McDougail | 273/157 R |
| 1,531,542 | 3/1925 | Cogshall | 273/157 R |
| 2,731,766 | 1/1956 | Rubin | 446/118 |
| 3,422,563 | 1/1969 | Kiley | 446/118 |
| 3,767,203 | 10/1973 | Eaker | 273/157 R |
| 3,993,313 | 11/1976 | Tillotson | 273/157 R |
| 4,052,074 | 10/1977 | Fogle et al. | 273/157 R |
| 4,606,732 | 8/1986 | Lyman | 446/104 |

*Primary Examiner*—Mickey Yu
*Assistant Examiner*—Michael Brown
*Attorney, Agent, or Firm*—Kane, Dalsimer, Sullivan, Kurucz, Levy, Eisele and Richard

[57] ABSTRACT

A toy activity center is provided with a base plate and a plurality of activity units to be received in holes in the base plate. The latter holes are defined by a silhouette plate whose edges are adapted to releasably receive the activity units. The units are formed with mechanical coupling means and the rear side of the base plate is provided with corresponding coupling projections so that the rear of the base plate may be used as a building base to which the activity units may be coupled.

8 Claims, 2 Drawing Sheets

Figure 1:
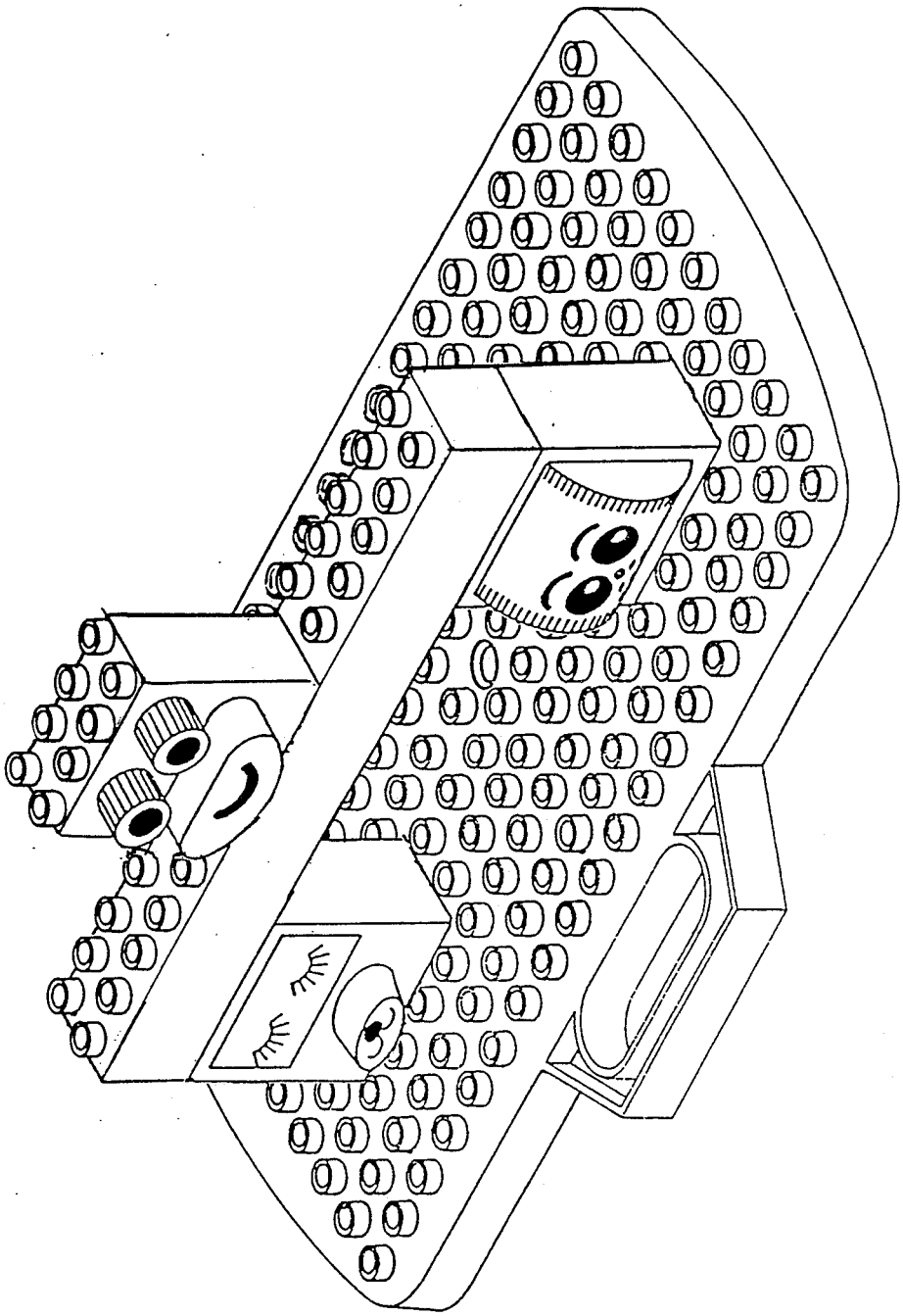

Fig 2
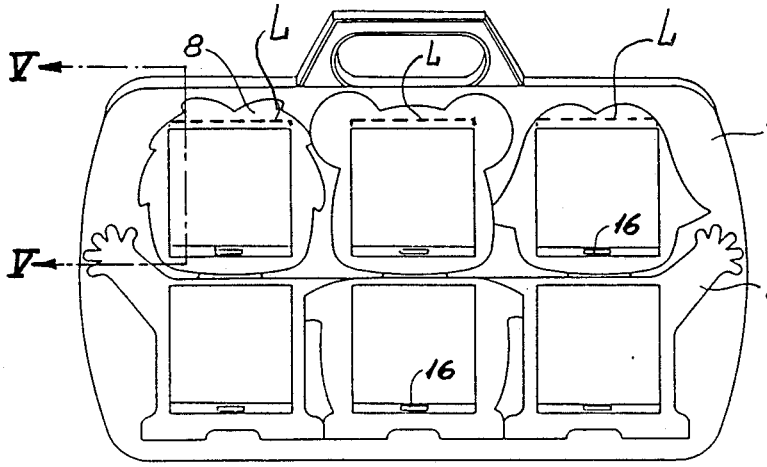
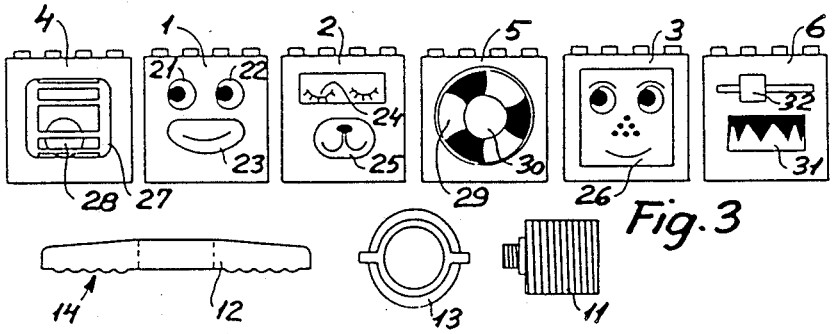
Fig. 3
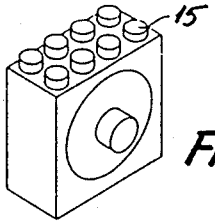
Fig. 4
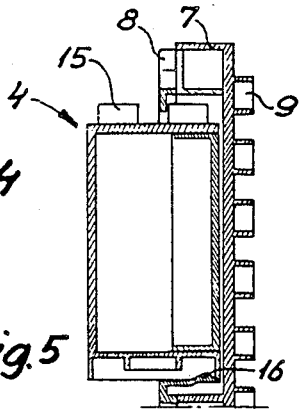
Fig. 5

TOY ACTIVITY CENTER

The invention concerns a toy activity centre comprising a base plate whose front side is provided with a plurality of removable activity units.

Such a toy is preferably intended for quite small children, the activity units being mechanically so adapted that upon activation (preferably motorily uncomplicated) they produce a visible or audible response to the activation. The drawback of the known activity centres is that the child's interest in these is of a very short duration because the child rapidly outgrows this infant toy.

The object of the invention is to provide an activity centre of the present type which comprises means appealing to the child's imagination to perform acts having a degree of difficulty reaching far beyond the field of use of the known activity centres.

This object is achieved in that the activity units have primary and secondary coupling means with a predetermined mutual modular spacing, said coupling means being adapted to be connected with the corresponding coupling means of another activity unit, and that the predominant part of the base plate rear side is provided with at least one of said two types of coupling means with said mutual modular spacing. After removal from the base plate, the activity units may be joined together in various positions like building blocks, with the base plate of the activity centre serving as a building base for this activity.

The activity units are formed in different ways depending upon the intended activity, but the general exterior features of the activity units preferably correspond to connectible building blocks known per se comprising mechanical coupling studs and means for receiving the coupling studs of an adjacent unit, as stated in claim 2. To ensure that the child cannot remove the activity units from the base plate before it is old enough, the activity centre is preferably formed with the locking means of claim 3 which improve the user safety. In this connection it is expedient that the coupling means of the activity units contribute to the locking effect, as stated in claim 4, while claim 5 defines some preferred details of the locking means.

An activity centre of the type described above may advantageously be placed on the bars of a play-pen, and it will thus be appreciated that it is important that the activity centre can be fixed securely to the play-pen owing to the safety of the child. The means defined in claim 6 provide for a particularly secure fixing of the activity centre since the bars of the play-pen will engage the coupling studs on the base plate rear side serving as coupling means. The features defined in claim 7 make it additionally certain that the mentioned flange does not slide with respect to the bars.

The invention will be explained more fully by the following description of an embodiment with reference to the drawing, in which FIG. 1 shows an embodiment of the activity centre of the invention, FIG. 2 is rear view of the activity centre of FIG. 1, FIG. 3 shows the activity centre of FIG. 1 in which the activity units and a fixing means are removed from a base plate, while FIG. 4 is a schematic perspective view of an activity unit.

FIG. 5 is a sectional view taken along reference lines V—V of FIG. 4 as indicated.

Initially, it will first be explained what is understood by an activity centre. The object of this toy has so far solely been that very small children can activate activity units, such as the units 1–6 shown in the figures, mechanically, so that the child can hear or see a response to the activation. Though unimportant to the understanding of the invention, it may e.g. be mentioned (see FIG. 3) that:

The activity unit 1 may e.g. operate so that the eyes 21, 22 or the mouth 23 may be pushed in individually or be released in that another one of these members is pushed in, the activity unit 2 has a flap 24 which can spring up so that the eyes will be visible when pressure is applied to the nose 25, the activity unit 3 may comprise a drum 26 with different facial features that may be changed by rotation of the drum, the activity unit 4 has a rotating drum 27 which contains a ball 28, the activity unit 5 may be so adapted that the sector disc 29 performs a rotary movement when the central button 30 is activated, while the activity unit 6 may be so adapted that the disc 31 rotates in a direction corresponding to the displacement of the button 32 across the disc.

The activity units shown just serve as examples since their function is not an expression of any new principle. But it is characteristic of the invention that the toy can be used not only in the manner described above, which is of interest for a relatively short period of the child's development, but also long after this period and inspire the child to take up new challenges, as will be described below.

The activity centre comprises a base plate 7 whose front side has six depressions to receive activity units of the above-mentioned type. The base plate is preferably produced by injection moulding, which is also the case with the silhouette plate, represented at 8, whose three contours resemble the silhouette of a human or animal body. Accordingly, the activity units 1–3 represent a head, while the activity units 4–6 are intended to sit in what corresponds to the body.

While the child is quite small, the activity units 1–6 will be placed in the base plate 7 so that the child cannot throw them about. In this position of use, it is expedient to attach the activity units to the bars of a play-pen, which may be done by the fixing means shown in FIG. 2.

As appears from FIG. 2, the rear side of the base plate 7 is provided with a plurality of rows of coupling studs 9 and is moreover provided with a fixing device 10 consisting of a threaded member 11, as shown in FIG. 3, a flange 12 and a union nut 13. The threaded member 11 has small threads to be received in a corresponding threaded hole in the base plate 7, and it will thus be appreciated that tightening of the union nut 13 will attach the activity centre to the bars of the play-pen. The attachment is particularly secure since the bars are received between the rows of coupling studs 9, so that the base plate 7 cannot be rotated with respect to the bars. Further, it is advantageous that the edge of the flange 12 facing the coupling studs 9 have friction increasing means e.g. in the form of teeth 14 to secure the flange against movement with respect to the play-pen bars.

As the child gets older, the activity units may be removed from the base plate 7, cf. FIG. 3. This makes the child realize that it is possible to interconnect the activity units mechanically since, according to the invention, the units are provided with coupling studs and complementary coupling means, respectively. In FIG. 4, the coupling studs are represented at 15 and correspond to the coupling studs 9, which are quite ordinary coupling means for building blocks. The complementary coupling means on the underside of the activity units are not visible in FIG. 4, but are quite ordinary known ones in connection with similar building blocks.

As it appears from the foregoing it is important that quite small children cannot remove the activity units from the base plate 7, and to achieve this the base plate is provided with some locking means to cooperate with the activity units. In the preferred embodiment, the upper edge of the holes in the silhouette plate 8 extend a distance down below the upper edge of the holes in the base plate 7, so that the rear row of coupling studs 15 extends upwardly behind the upper edge of the holes in the silhouette plate 8. The bottom of the holes in the base plate is formed with a spring tongue 16 adapted to cooperate with the lower edge of the activity unit so that the units may be removed from the base plate with some difficulty.

As the child's interest in the individual activity unit declines, the child can begin to couple the units together in different ways. It is also conceivable that the child already has some ordinary building blocks which can be connected with the activity units described, so that the child can begin to build more units together than the six mentioned ones. In this respect it is essential that the rear side of the base plate 7 is provided with the coupling studs 9 because the base plate can be removed from the play-pen and be used as a building base for the blocks by screwing off the threaded member 11 from the base plate 7. Thus the child will have challenges in the toy described far beyond the age at which the interest in activity centres normally ceases.

We claim:

1. A toy activity center comprising:

a base plate having a front side provided with means for receiving a plurality of removable activity units and a rear side, each of said activity units including means for activation and audio or visual means responsive to said activation means and primary and secondary coupling means with a predetermined mutual modular spacing, said coupling means being adapted to be connected with the corresponding coupling means of another activity unit; and, the predominant part of the base plate rear side is provided with at least one of said primary and secondary coupling means with said mutual modular spacing.

2. An activity center according to claim 1 characterized in that the activity units are rectangular blocks whose top sides are provided with a plurality of protruding coupling studs and whose bottom sides are provided with a plurality of complementary cavities to receive the coupling studs of an adjacent unit.

3. An activity centre according to claims 1, 2, or 5 characterized in that the rear side of the base plate is provided with a plurality of rows of coupling studs with said mutual modular spacing and adapted to be coupled together with a fixing device for fixing the activity centre to a wall, with parts of the wall being fixed between the rows of coupling studs and the fixing device.

4. An activity center according to claims 1, 2, or 3 characterized in that the rear side of the base plate is provided with a plurality of rows of coupling studs with said mutual modular spacing and adapted to be coupled together with a fixing device including a flange whose edges facing the rear side of the base plate has friction increasing means for fixing the activity center to a wall, with parts of the wall being fixed between rows of coupling studs and the fixing device.

5. An activity centre according to claim 1, characterized in that the base plate has releasable locking members to engage the activity units.

6. An activity centre according to claim 5, wherein the front side of the base plate is provided with depressions to receive activity units, characterized in that the locking members comprise locking means for cooperation with the coupling means of the activity units.

7. An activity centre according to claim 6, characterized in that the locking means comprise a downwardly extending edge along the upper side of the depressions, said edge being adapted to be received between two rows of coupling studs on an activity unit, and a snap lock placed in the vicinity of the underside of the depression for cooperation with the underside of the activity unit.

8. An activity center according to claim 4 characterized in that the locking means comprise a downwardly extending edge along the upper side of the depressions, said edge being adapted to be received between two rows of coupling studs on an activity unit, and a snap lock placed in the vicinity of the underside of the depression for cooperation with the underside of the activity unit.

* * * * *

UNITED STATES PATENT AND TRADEMARK OFFICE

CERTIFICATE OF CORRECTION

PATENT NO. : 4,897,066

DATED : January 30, 1990

INVENTOR(S) : Erik P. Tapdrup; Flemming H. Olsen

It is certified that error appears in the above-identified patent and that said Letters Patent is hereby corrected as shown below:

On the title page, "Foreign Application Priority" date from "May 29, 1987" to --May 29, 1986--.

Signed and Sealed this

Thirteenth Day of August, 1991

*Attest:*

HARRY F. MANBECK, JR.

*Attesting Officer*

*Commissioner of Patents and Trademarks*